US005232421A

United States Patent [19]

Chen et al.

[11] Patent Number: 5,232,421

[45] Date of Patent: Aug. 3, 1993

[54] STEPPER

[75] Inventors: Jin-Liang Chen, No. 14, Alley 5, Lane 22, Kao-Cheng Wu St., Pa-Te Hsiang, Taoyuan Hsien; Cheng-Chang Wu, Chungli City, both of Taiwan

[73] Assignee: Jin-Liang Chen, Taiwan

[21] Appl. No.: 921,515

[22] Filed: Jul. 29, 1992

[51] Int. Cl.[5] ..... A63B 22/04

[52] U.S. Cl. ..... 482/53; 482/908

[58] Field of Search ..... 482/51, 52, 53, 111-113, 482/79, 80, 908

[56] References Cited

U.S. PATENT DOCUMENTS 4,563,001 1/1986 Terauds ..... 482/53

4,838,543 6/1989 Armstrong et al. ..... 482/53

*Primary Examiner*—Stephen R. Crow

*Attorney, Agent, or Firm*—Ladas & Parry

[57] ABSTRACT

A stepper includes a base frame, two swing arms, two hydraulic cylinders and an adjustment assembly. Each of the swing arms is mounted pivotally on the base frame at one end and carries a pedal on the other end. Each of the hydraulic cylinders is mounted pivotally on one of the pedals at one end and on the base frame at the other end. The adjustment assembly is disposed on the base frame and permits adjustments in the angular displacement of the pedals.

1 Claim, 4 Drawing Sheets

STEPPER

BACKGROUND OF THE INVENTION

1. Field Of The Invention

This invention relates to a stepper, more particularly to a variable resistance stepper which can be adjusted by changing the angular displacement of the pedals.

2. Description Of The Related Art

A conventional stepper is shown in FIG. 1. The amount of resistance produced against two lever arms (1) of the stepper is controlled by a driving belt (not shown). The main drawback of the conventional stepper shown in FIG. 1 is that the amount of resistance produced against the two lever arms (1) is fixed and is difficult to adjust. Furthermore, the driving belt is easily broken, thereby resulting in accidents.

U.S. Pat. No. 4,563,001 discloses an exercise device, the amount of resistance produced against the two lever arms of which is adjusted by moving two brackets on each lever arm of the exercise device forward or backward, individually or in combination. The drawback of this exercise device is that adjustments are time consuming and cannot be accurately effected.

SUMMARY OF THE INVENTION

Therefore, the main object of this invention is to provide a stepper, the amount of resistance produced against pedals of which can be easily and accurately effected by changing the angular displacement of the pedals.

According to this invention, a stepper includes a base frame, two swing arms, two hydraulic cylinders and an adjustment assembly. Each of the swing arms is mounted pivotally on the base frame at one end thereof and carries a pedal on the other end of the swing arm. One end of each of the hydraulic cylinders is mounted pivotally on one of the pedals, while the other end of the same is mounted pivotally on the base frame. The adjustment assembly is disposed on the base frame and permits adjustments in the angular displacement of the pedals.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
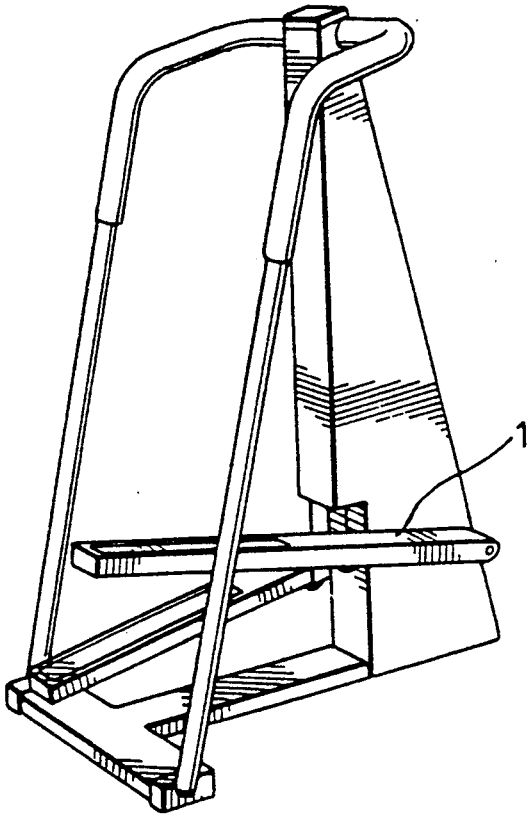
FIG. 1 PRIOR ART
FIG. 1 is a perspective view of a conventional stepper.
Figure 2:
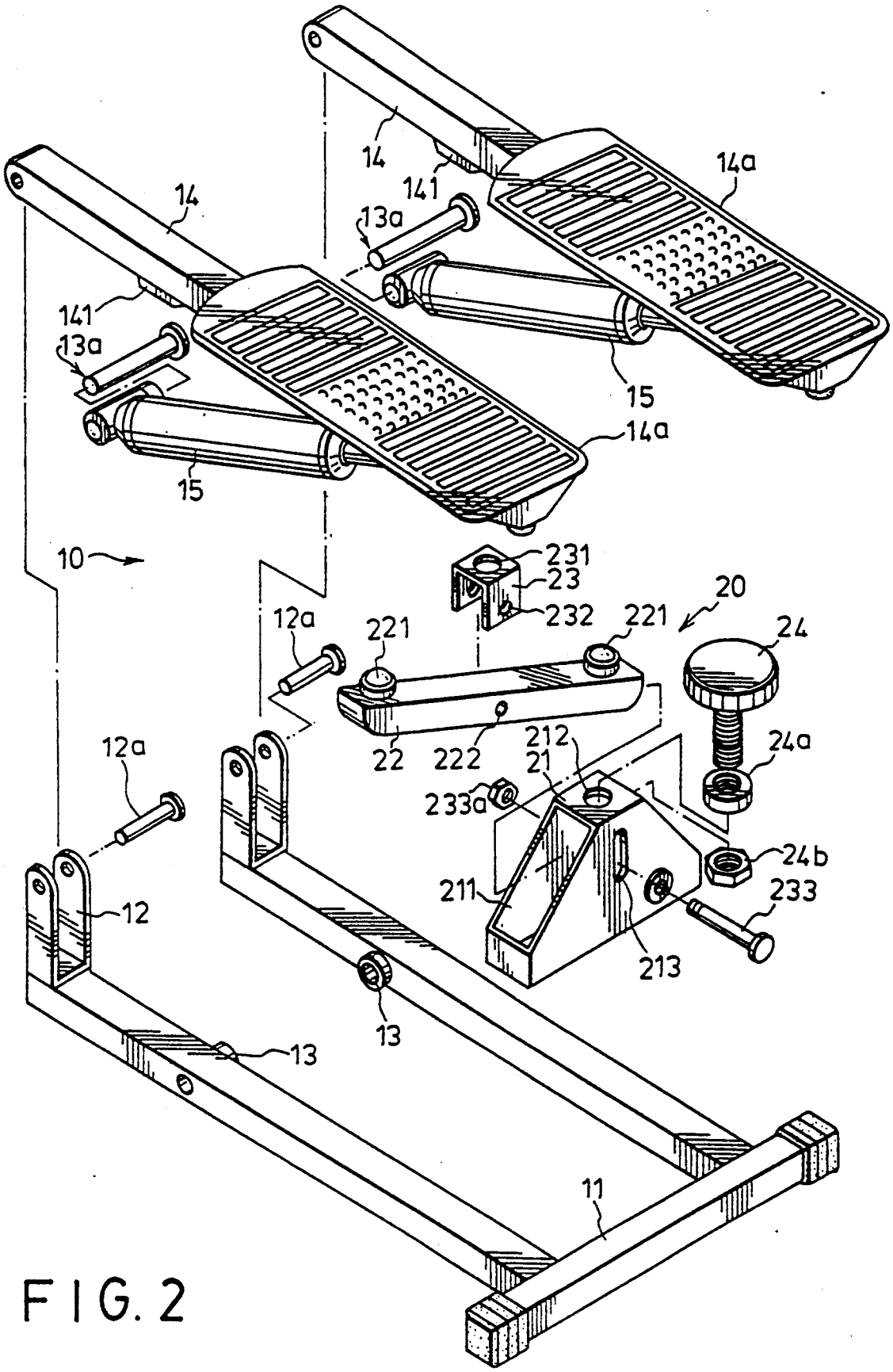
FIG. 2 is an exploded view of a stepper according to this invention.

Referring to FIG. 2, a stepper of this invention includes a pedal assembly (10) and an adjustment assembly (20).

The pedal assembly (10) includes a generally U-shaped base frame (11), two U-shaped brackets (12), two aligned positioning rods (13), two swing arms (14), two pedals (14*a*) and two hydraulic cylinders (15).

The base frame (11) has a pair of parallel longitudinal members and a cross member that interconnects one end of the parallel longitudinal members. The U-shaped brackets (12) are respectively secured on the other end of the parallel longitudinal members.

Each of the swing arms (14) is mounted pivotally on one of the U-shaped brackets (12) by a pivot pin (12*a*) at one end and carries a pedal (14*a*) on the other end. A projection (141) projects from a bottom surface of each swing arm (14).

Each of the hydraulic cylinders (15) is mounted pivotally on one of the pedals (14*a*) at one end and is mounted pivotally on one of the positioning rods (13) of the base frame (11) by a pivot pin (13*a*) at the the other end.

The adjustment assembly (20) includes a hollow adjustment seat member (21), a reciprocating lever (22), an inverted U-shaped connecting element (23) and a rotary knob member (24).

The hollow adjustment seat member (21) is fixed on the base frame (11) and has a rectangular lower portion and a trapezium upper portion. The trapezium upper portion includes two trapezium side walls and a square top wall and confines a large space (211) therein. A receiving hole (212) is formed in the central portion of the square top wall. A vertical slide slot (213) is formed in each of the trapezium side walls of the seat member (21).

The reciprocating lever (22) has two end portions which are positioned under the swing arms (14), respectively. One of the pedals (14*a*) can be depressed to pivot the corresponding swing arm (14) downward so as to impel the corresponding end portion of the reciprocating lever (22) downward to engage the base frame (11), thereby pivoting the other end portion of the reciprocating lever (22) upward. A cushion (221) is fixed on each of the end portions of the reciprocating lever (22) so as to provide two contact points between the reciprocating lever (22) and the projections (141) of the swing arms (14). A pivot hole (222) is formed in the middle portion of the reciprocating lever (22).

The inverted U-shaped connecting member (23) has a horizontal top wall and two vertical side walls. A large hole (231) is formed in the central portion of the top wall. Two small holes (232) are respectively formed in the two side walls. A nut (233) engages the externally threaded end of the pivot pin (233). The pivot pin (233) extends through the vertical slide slot means (213), the small holes (232) and the pivot hole (222). Accordingly, both the connecting member (23) and the middle portion of the reciprocating lever (22) are movable vertically in the large space (211) of the hollow adjustment seat member (21).

The rotary knob member (24) has a disc disposed at a top thereof and an externally threaded vertical stem connected securely to the bottom surface of the disc. An internally threaded element (24*a*) is welded to the top portion of the hollow adjustment seat member (21). The stem engages threadably the internally threaded element (24*a*) of the seat member (21), and extends through the receiving hole (212) of the seat member (21) and the large hole (231) of the connecting member (23). A nut (24*b*) engages the stem so as to retain the connecting member (23) on the stem.

Figure 5:
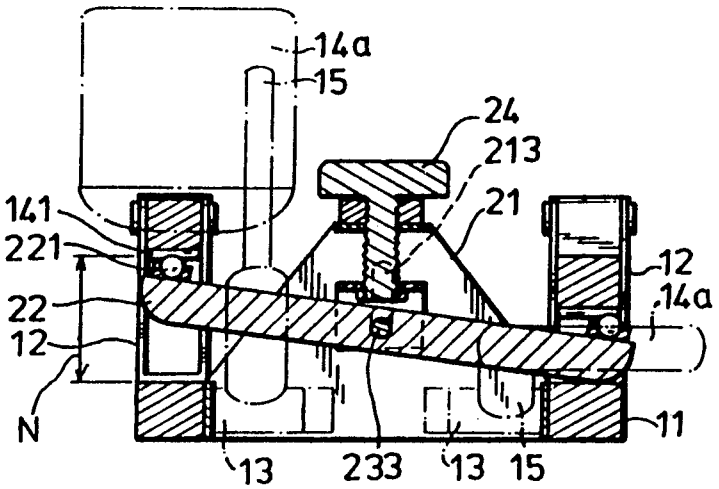
FIG. 5 is a schematic sectional view illustrating the smallest angular displacement of the pedals according to this invention.
Figure 4:
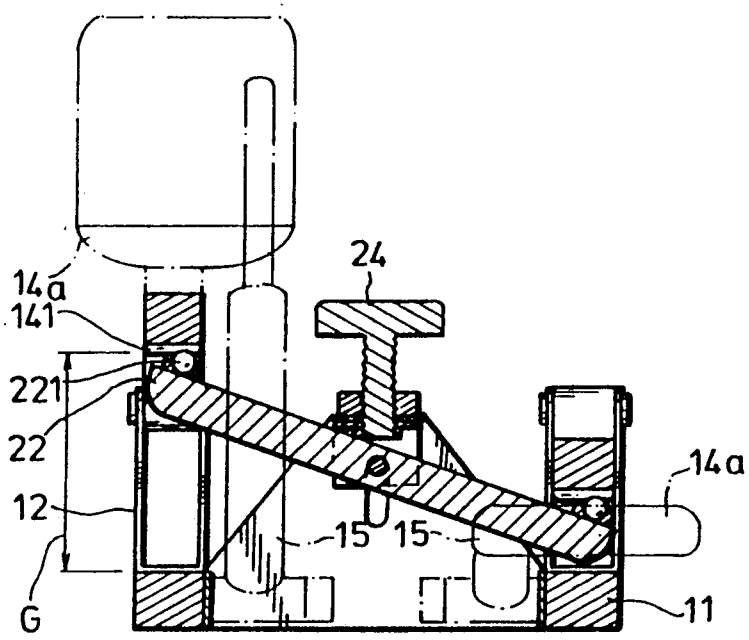
FIG. 4 is a schematic sectional view illustrating the greatest angular displacement of the pedals according to this invention.

Referring to FIGS. 4 and 5, when the disc of the rotary knob member (24) is rotated, the stem of the rotary knob member (24) moves upward or downward so as to move the pivot pin (213) and the middle portion of the reciprocating lever (22) vertically.

Figure 3:
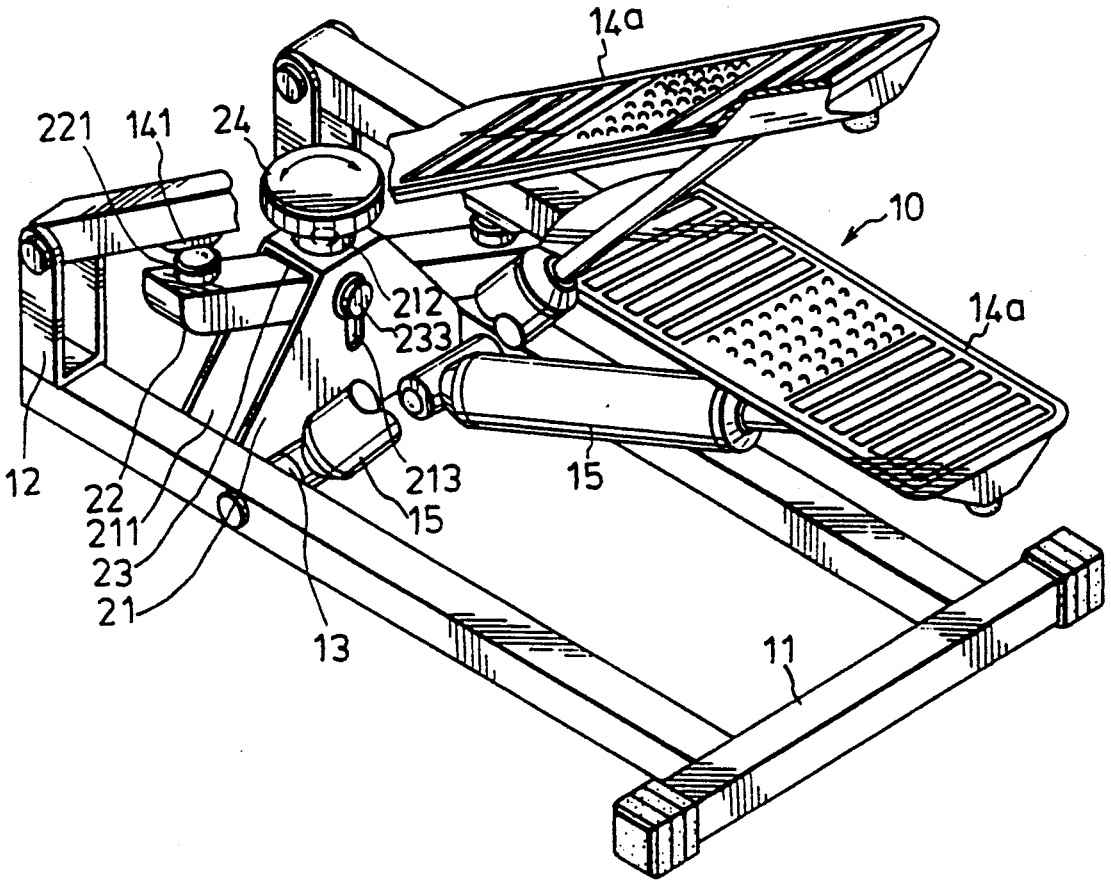
FIG. 3 is a perspective view of the stepper according to this invention.

Referring to FIGS. 3, 4 and 5, when operating the stepper of the present invention, the user depresses the right foot pedal (14*a*) until the right bottom end of the reciprocating lever (22) rests on the base frame (11). When the depressing force is shifted from the right foot to the left foot, the reciprocating lever (22) pivots until the left bottom end of the reciprocating lever (22) rests on the base frame (11). Therefore, an action-reaction structure causes the reciprocating lever (22) to pivot about the pivot pin (13*a*) so as to move the left end of the reciprocating lever (22) upward in response to downward movement of the right end of the reciprocating lever (22) and vice versa. As a consequence, when one of the swing arms (14) pivots downward, the other one of the swing arms (14) pivots upward.

Referring once more to FIGS. 4 and 5, the amount of resistance produced against the pedals (14*a*) can be adjusted by changing the angular displacement of the pedals (14*a*). In FIG. 4, both the connecting member (23) and the middle portion of the reciprocating lever (22) are moved to the highest position so as to produce the greatest angular displacement (G) of the pedal (14*a*), thereby creating a greatest amount of resistance against movement of the pedals (14*a*). In FIG. 5, both the connecting member (23) and the middle portion of the reciprocating lever (22) are moved to the lowest position so as to produce the smallest angular displacement (N) of the pedal (14*a*), thereby creating a smallest amount of resistance against movement of the pedals (14*a*).

Therefore, the amount of resistance produced against the pedals (14*a*) can be easily and accurately adjusted by rotating the rotary knob member (24).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A stepper, comprising:

a base frame;

two swing arms, each of said swing arms being mounted pivotally on said base frame at one end and carrying a pedal on the other end;

two hydraulic cylinders, each of said hydraulic cylinders being mounted pivotally on one of said pedals at one end and on said base frame at the other end; and an adjustment assembly disposed on said base frame to adjust angular displacement of said pedals, said adjustment assembly including:

a hollow adjustment seat member fixed on said base frame and including a vertical slide slot means formed therethrough and an internally threaded element fixed on a top portion of said seat member;

a pivot pin mounted slidably in said vertical slide slot means of said seat member;

a reciprocating lever disposed rotatably on said pivot pin at a middle portion thereof and having two end portions which are positioned under said swing arms respectively, each of said pedals being capable of being depressed to turn a corresponding said swing arm downward so as to impel a corresponding said end portion of said reciprocating lever downward to engage said base frame, thereby turning the other one of said end portions of said reciprocating lever upward; and a rotary knob member having a disc disposed at a top thereof and an externally threaded vertical stem connected securely to a bottom surface of said disc, said stem engaging threadably said internally threaded element of said seat member;

whereby, when said disc of said rotary knob member is rotated, said stem of said rotary knob member moves upward or downward to as to move said pivot pin and said middle portion of said reciprocating lever vertically.

* * * * *